US005477029A

United States Patent [19]

Skutt et al.

[11] Patent Number: 5,477,029

[45] Date of Patent: Dec. 19, 1995

[54] KILN WITH HINGED CONTROL PANEL

[75] Inventors: James E. Skutt, Portland, Oreg.; Michael J. Hampel, Vancouver, Wash.

[73] Assignee: Skutt Ceramic Products, Inc., Portland, Oreg.

[21] Appl. No.: 188,959

[22] Filed: Jan. 28, 1994

[51] Int. Cl.[6] ..... F27B 5/14

[52] U.S. Cl. ..... 219/390; 219/521; 219/492; 361/688; 432/250

[58] Field of Search ..... 219/482, 483, 219/490, 492, 493, 494, 497, 521, 390, 400; 174/10, 15.7, 16.1, 17 CT, 50; 361/714, 784, 383, 389; 432/250; 165/1, 47

[56] References Cited

U.S. PATENT DOCUMENTS

| | | | |
|---|---|---|---|
| 3,681,663 | 8/1972 | Albers | 317/100 |
| 3,958,923 | 5/1976 | Duncan | 432/250 |
| 4,215,265 | 7/1980 | White | 219/390 |
| 4,500,943 | 2/1985 | Greene | 361/383 |
| 4,535,386 | 8/1985 | Frey et al. | 361/389 |
| 4,705,930 | 11/1987 | Sathre, Jr. et al. | 219/492 |
| 4,742,864 | 5/1988 | Duell et al. | 165/1 |
| 4,754,179 | 6/1988 | Capuano et al. | 310/71 |
| 4,837,423 | 6/1989 | Peterson et al. | 219/390 |
| 4,897,526 | 1/1990 | Anthony | 219/492 |
| 5,285,355 | 2/1994 | Chabert et al. | 361/784 |

OTHER PUBLICATIONS

*Cress Firemate* brochure, Cress Mfg. Company, U.S.A.
*Aim Kilns* catalog #209, Aim Kiln Mfg. Co., U.S.A.
*Skutt Kilns* catalog, Skutt Ceramic Products, Inc., Aug. 1992, U.S.A.
*Duncan Kiln Catalog,* Jun., 1992, U.S.A.
*Paragon Kilns* catalog, Paragon Industries, Inc., U.S.A.
*Evenheat Kiln Inc.* catalog, 1992, U.S.A.
*Programatic Kilns* catalog, L & L Mfg. Co, Inc., Feb. 1993, U.S.A.
*High Fire Kilns Plus!* catalog, Knight Kiln Co., Feb. 1993, U.S.A.
*Cress M–Series* catalog, Cress Mfg. Company, U.S.A.

*Primary Examiner*—Tu Hoang
*Attorney, Agent, or Firm*—Kolisch, Hartwell, Dickinson, McCormack & Heuser

[57] ABSTRACT

A kiln assembly is disclosed, including a heated kiln with an attached control box containing controls connected to the kiln heater. The control box is mounted on the kiln by a hinge, and can be secured with a closure device. A thermally insulated baffle is disposed within the control box and is spaced rearwardly from the front of the control box, and is essentially coextensive with the length and width of the control box to form a chimney. Louvers are provided to allow the flow of air through the chimney. A bank of plugs and sockets is exposed on the baffle, and interconnects the controls with the heater.

31 Claims, 4 Drawing Sheets

KILN WITH HINGED CONTROL PANEL

BACKGROUND OF THE INVENTION

This invention relates to kilns, and more specifically to kilns used for firing pottery or ceramics. It is common in the art to heat such kilns with one or more electric heaters, and to control both the duration and the temperature of such heating with a heater controller. This controller is often contained in a control box attached to the kiln exterior. A power cord is attached to the control box to provide electricity for both the controller and the electric heater. The controller contains a timer to monitor the duration of heating. A temperature sensor incorporated in the kiln is connected to the controller to sense the temperature in the interior of the kiln. The controller can then regulate the electric power supplied to the electric heater to maintain the desired temperature for the desired duration.

When the kiln is operational, it produces temperatures of upwards of 2000 degrees Fahrenheit. While kilns are lined with firebricks, which provide some insulation, the exterior of the kiln still gets hot. Since the control box is mounted on the hot exterior, and the heat can damage the controller, a kiln that is regularly used requires frequent maintenance. This maintenance usually includes accessing the wires connected to the heater and the outputs from the controller. In a traditional kiln, this requires that the control box be completely removed from the kiln. The control box is often quite heavy., and unless the wires connecting the controls to the heater are exceedingly long, the control box must be supported in an upright position so that access may be had to the wiring while the controls are still connected to the electric heater. Because of the weight and size of the control box, this is often quite awkward. Should more complete maintenance be required, the wires connected to the controls and heater must be disconnected so that the control box can be completely separated from the kiln and placed on a workbench for further maintenance. Connecting and disconnecting the wires is cumbersome because there are often several wires to be connected, and because the heavy control box must be supported while making these connections, as described above.

One object of the invention is to improve the attachment means for a control box in a kiln assembly.

Another object of the invention is to improve the thermal protection provided for the controls contained within the control box of a kiln assembly.

A further object of the invention is to increase the cooling effect of air within the control box.

Another object of the invention is to improve the attachment and connection of the control box to a sectionalized kiln.

Yet another object is to create a chimney within a control box attached to a kiln assembly, wherein the chimney increases the dissipation of heat from the controls contained in the control box.

The preferred embodiment of the invention herein described embraces a kiln assembly that incorporates the following: a control box that allows for easy attachment and detachment of the control box from a kiln; wiring connectors that allow for easy interconnection and disconnection of the controls to the heater; and a configuration of the control box that allows for improved thermal protection and ventilation of the controllers contained within the control box.

DETAILED DESCRIPTION OF THE PREFERRED EMBODIMENT

Figure 1:
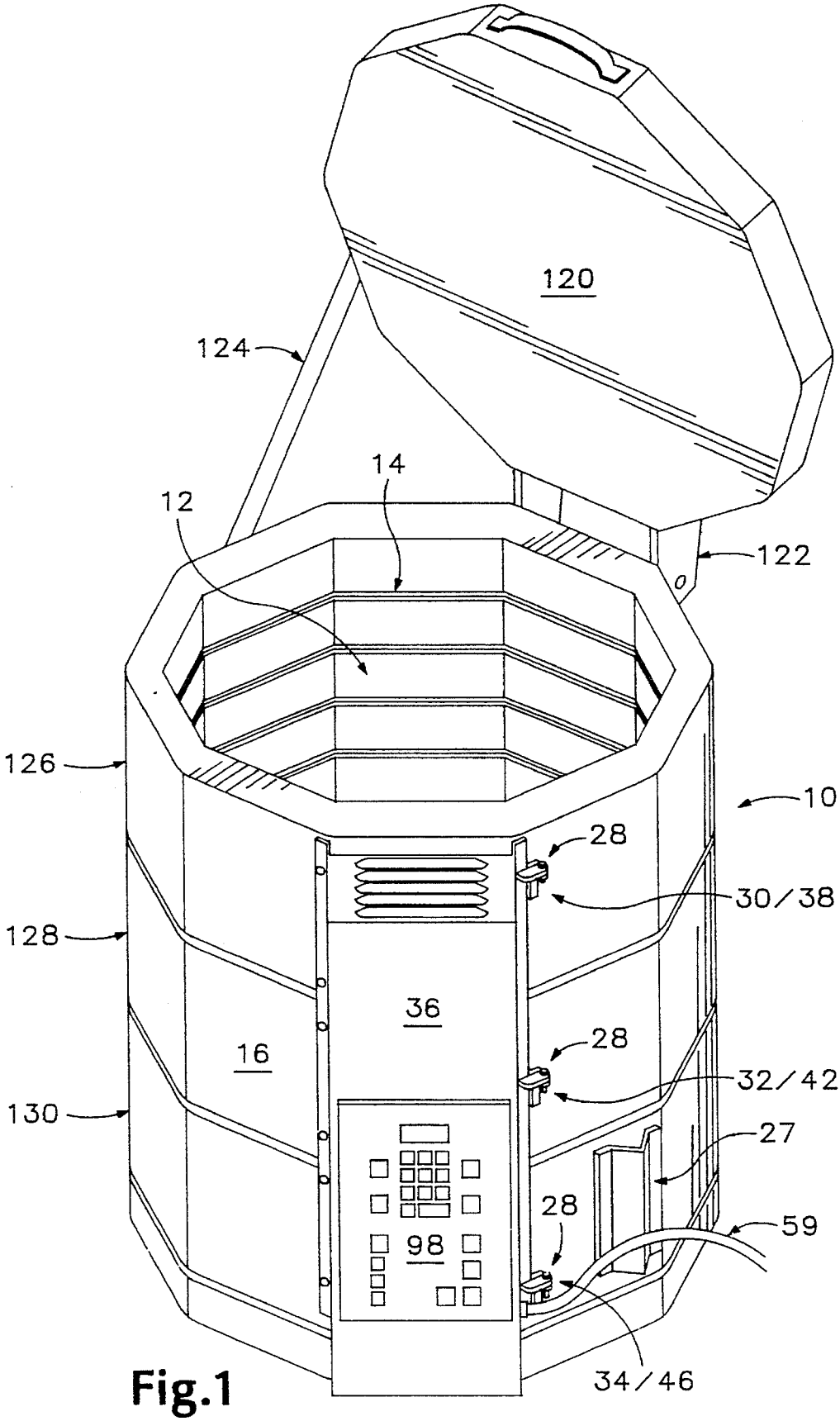
FIG. 1 is a perspective view of the kiln of the present invention, taken from the top and front of the kiln, showing the control box attached to the kiln and in its closed position.
Figure 2:
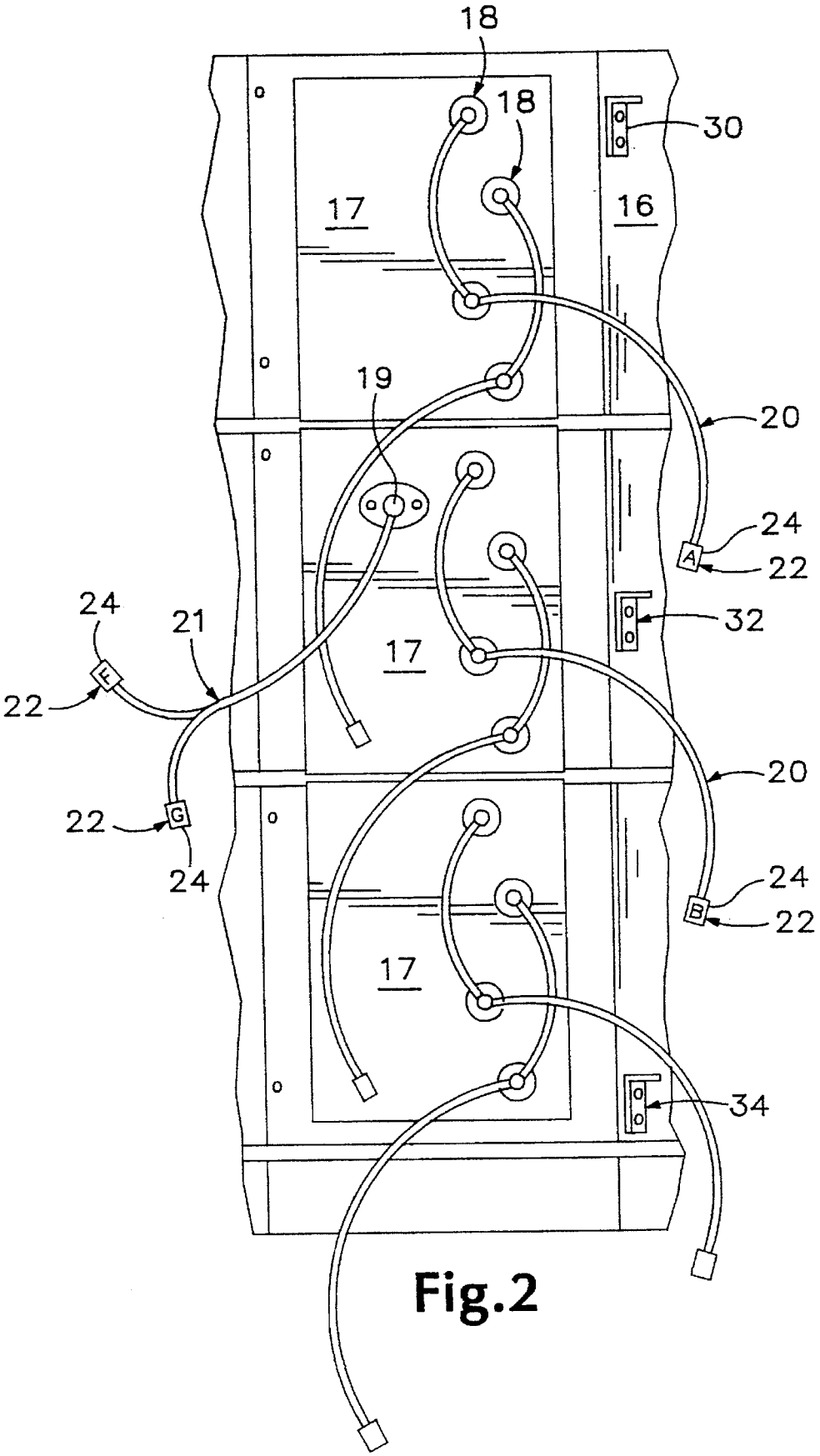
FIG. 2 is a detail of the front elevation of the kiln of the present invention with the control box removed, showing the portion of the kiln exterior to which the control box is attached.

Referring to FIGS. 1 and 2, the kiln assembly of the preferred embodiment is indicated generally at 10 in the form of an upright kiln body with an attached control box. The body defines an enclosed space, or kiln interior, indicated generally at 12, and electric heaters 14 are shown disposed within the kiln interior. The kiln exterior is shown generally at 16.

It is common in the art for such heaters to be made from formed resistance wire, with the wire being bent to form tabs (not shown) at either end of the heater to which electric current can be supplied to generate the required heat. Heater tabs extend from kiln interior 12 to kiln exterior 16, pass through mounting plate 17, and are normally surrounded by insulators 18. A temperature sensor 19 is mounted on mounting plate 17, and penetrates kiln exterior 16 to sense the temperature inside the kiln. Electrically conductive flexible wires 20 can then be connected to the heater tabs to supply the necessary electric current, and are shown with sockets 22 attached to one end. Similarly, wire 21 can be connected to temperature sensor 19, and is shown with sockets 22 attached. Sockets 22 thus hang free adjacent kiln exterior 16 until connected to plugs, as described below. Each socket 22 is provided with a unique identifier, shown generally at 24. Sockets 22 can be identical in size, or each socket 22 can be sized as required by the electrical loads or other physical requirements for each connector. Electrically conductive wires can be referred to more generally as conductors.

In the preferred embodiment, a cable bumper 27 is attached to exterior 16 in the form of a piece of bent metal attached vertically to the lower portion of exterior 16.

A hinge with a vertical pivot axis is shown generally at 28. In the preferred embodiment, the parts of the hinge that are attached to kiln exterior 16 are shown as upper receptacle 30, middle receptacle 32, and lower receptacle 34. These receptacles are sized to receive a pin, as described below. The receptacles are attached to kiln exterior 16 in-line with each other vertically, and are adjacent cable bumper 27.

Figure 3:
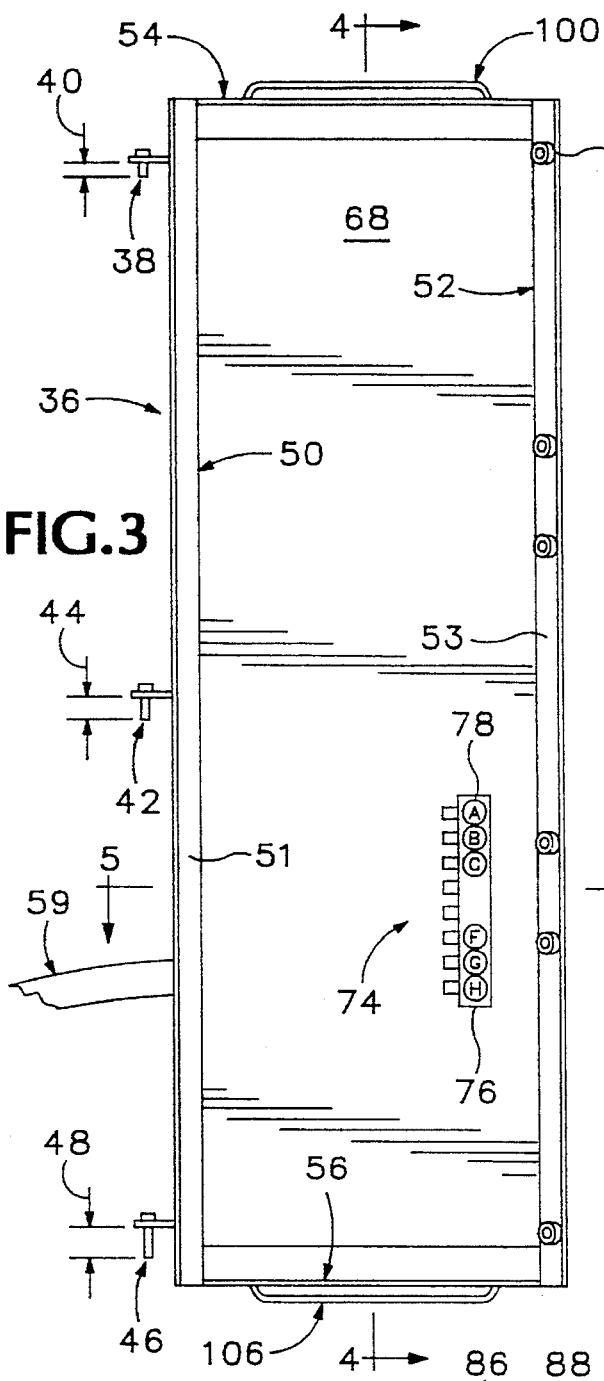
FIG. 3 is a rear elevation of the control box of the present invention, shown removed from the kiln.

Referring to FIG. 3, a control box is shown generally at

Figure 8:
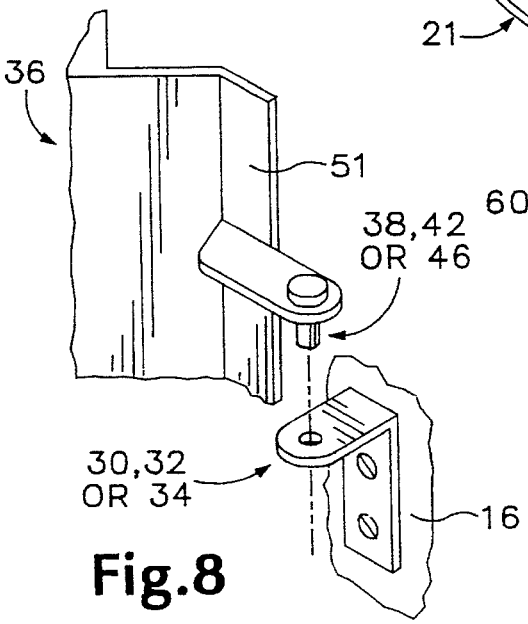
FIG. 8 is an exploded detail perspective of a portion of the hinge of the present invention.

36. The remaining parts of hinge 28 are preferably attached to the control box in the form of upper pin 38 having a length 40, middle pin 42 having a length 44, and lower pin 46 having a length 48. Pins 38, 42 and 46 are cylindrically shaped, and fit snugly within receptacles 30, 32 and 34, thus allowing each pin to be smoothly rotated about its long axis relative to the respective receptacle. The resulting pin-receptacle combinations form an upper hinge, middle hinge and lower hinge respectively. A typical hinge of the preferred embodiment is shown in detail in FIG. 8. The pins are of sufficient length that the pins are not dislodged from their respective receptacles by normal vibrations or bumping.

In the preferred embodiment, each pin is of a different length, so that when control box 36 is to be attached to the kiln, the longest pin is first mated with its corresponding receptacle, then the second longest pin is mated with its corresponding receptacle, and finally the remaining pin is mated with the remaining receptacle. Thus only one pin need be aligned with one receptacle at a time. When the pins and receptacles are so mated, control box 36 can be rotated about hinge 28 relative to kiln exterior 16.

In the preferred embodiment, lower pin 46 is the longest pin, and upper pin 38 is the shortest pin, thus lower pin 46 is first aligned with lower receptacle: 34, then middle pin 42 is aligned with middle receptacle 32, and finally upper pin 38 is aligned with upper receptacle 30. Thus control box 36 can be attached to exterior 16 by inserting pins 38, 42 and 46 into receptacles 30, 32 and 34 respectively.

Receptacles 30, 32 and 34 and pins 38, 42 and 46 are sized such that when the pins and receptacles are mated, control box 36 is spaced away from kiln exterior 16, and is only in direct thermal contact with kiln exterior 16 through the pins and receptacles.

Many alternative configurations of pins 38, 42 and 46 and receptacles 30, 32 and 34 are possible. For smaller kilns, it may be desirable to use only a two-pin hinge, thus only upper receptacle 30, upper pin 38, lower receptacle 34 and lower pin 46 are necessary. Larger kilns may use more than three mated pairs of pins and receptacles. In addition, one or more of the mated pairs of pin and receptacle could be reversed, so that the pin is attached to kiln exterior 16, and the receptacle is attached to control box 36. The order of attachment is not crucial, thus any of the pins can be the longest pin. Furthermore, the advantage of only needing to align one pin with one receptacle at a time can be achieved by varying the vertical location of the receptacles, rather than the length of the pins.

Figure 4:
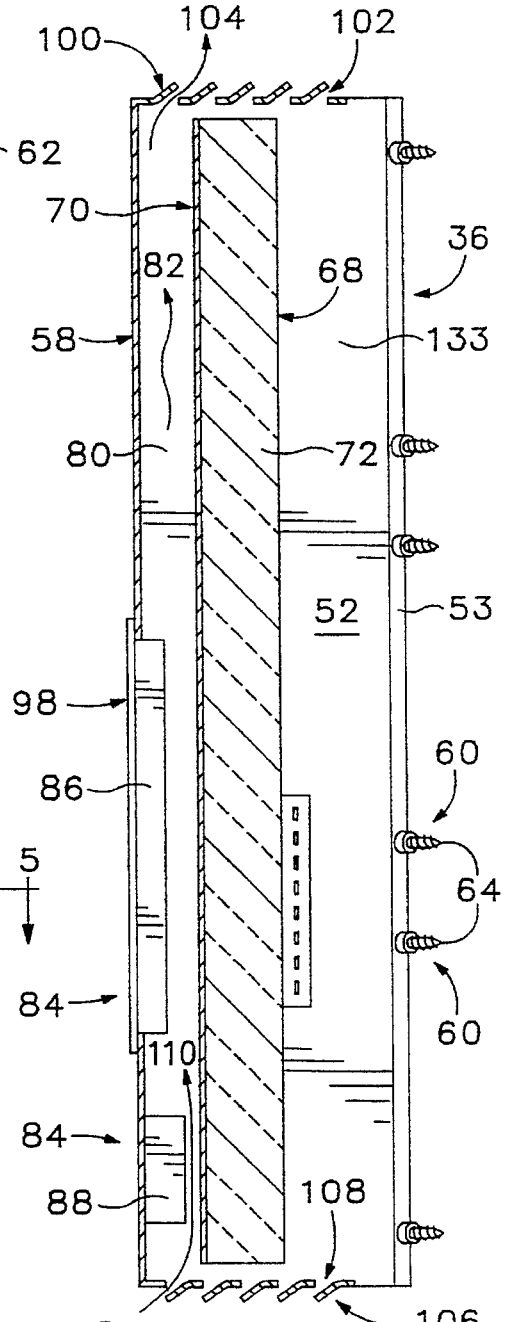
FIG. 4 is a sectional side elevation of the control box shown in FIG. 3, taken generally about the line 4—4 shown in FIG. 3.
Figure 5:
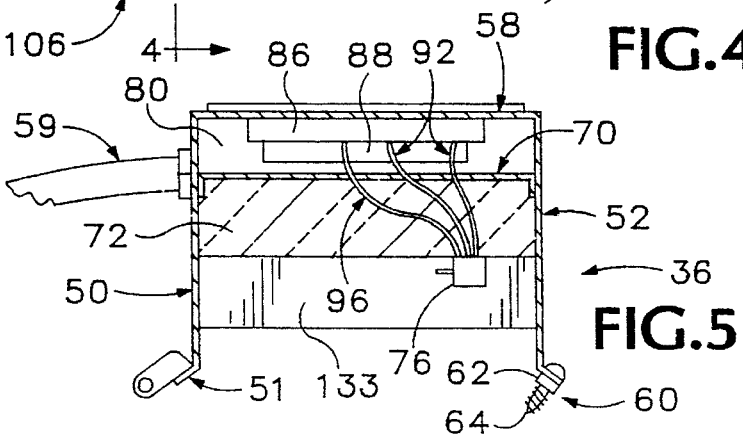
FIG. 5 is a sectional plan view of the control box shown in FIG. 3, taken generally about the line 5—5 shown in FIG. 3.

In the preferred embodiment the control box is an elongate hollow box, shown best in FIGS. 3 through 5. Control box 36 is rectangular and has multiple sides, including a first side 50, a second side 52, a top 54, a bottom 56, and a front 58. Second side 52 is spaced horizontally from first side 50. Top 54, bottom 56 and front 58 extend from first side 50 to second side 52 to define a hollow interior with an open back. Electric power supply conductors in the form of flexible power cable 59 are attached to control box 36 to provide power to the control box. Power cable 59 is preferably attached to the lower portion of first side 50. Attached to second side 52 is a closure device 60 shown in the form of a spacer 62 through which screw 64 extends to penetrate the kiln exterior. Spacer 62 is preferably a washer fixedly attached to second side 52.

Figure 6:
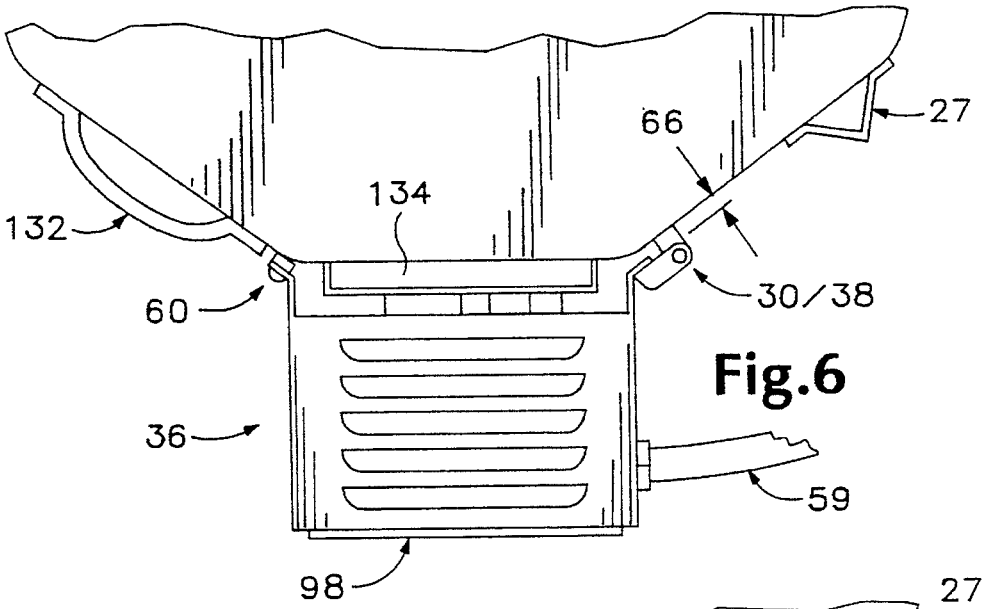
FIG. 6 is a top plan detail of the kiln, shown with the control box attached to the kiln and in its closed position.
Figure 7:
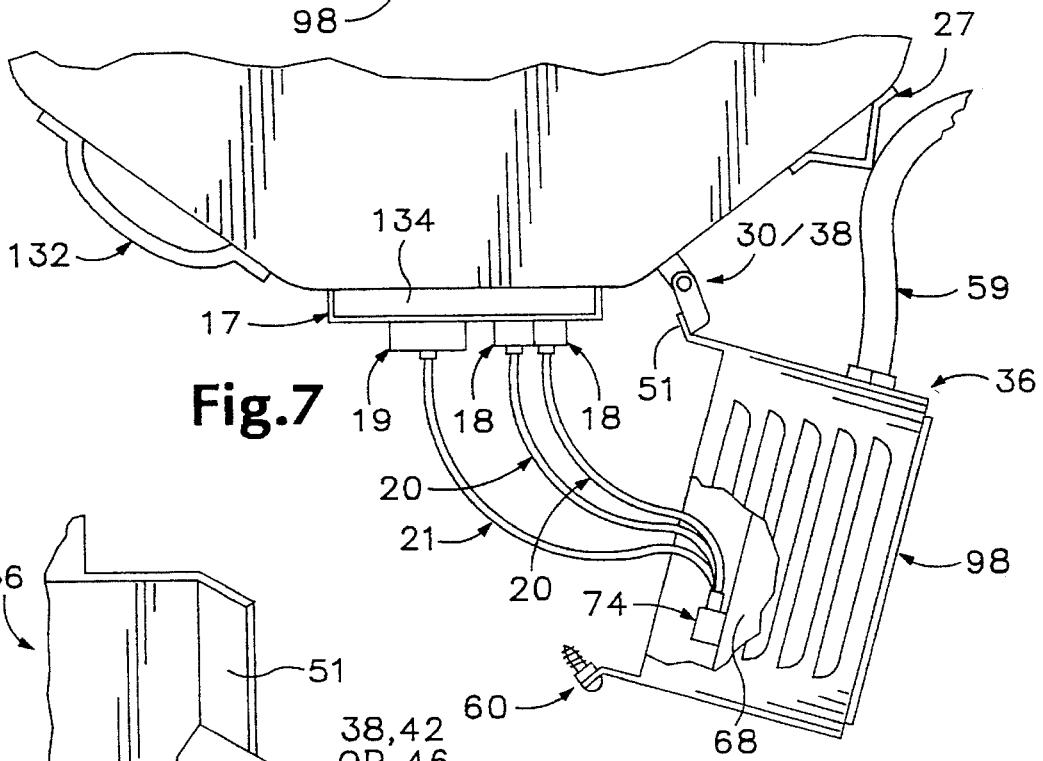
FIG. 7 is a top plan detail of the kiln, shown with the control box attached to the kiln and in its open position, with the top of the control box being cut-away to show the plugs and sockets that interconnect the heater to the heater controls.

When control box 36 is attached to exterior 16 by hinge 28, and the control box is in its closed position as shown in FIG. 6, it will be seen that first side 50 and second side 52 each have an edge that is adjacent to exterior 16. First side 50 can be bent outwardly at the edge adjacent to exterior 16 to form first flange 51. It has been found that first flange 51 facilitates attachment of the pins to first side 50. Second side 52 can be bent outwardly at the edge adjacent to exterior 16 to form second flange 53. It has been found that second flange 53 facilitates attachment of closure device 60 to second side 52.

Once control box 36 is attached to exterior 16 by hinge 28, it can be held in its closed position by closure device 60. Specifically, this is done by screwing screw 64 into exterior 16. When control box 36 is thus attached, a gap shown generally at 66 remains between control box 36 and exterior 16. Control box 36 is only in direct thermal contact with exterior 16 at the pins attached to first side 50, and at closure device 60 attached to second side 52. First flange 51 and second flange 53 are essentially parallel to the plane of exterior 16, and the open back of the control box faces the kiln exterior.

Referring to FIGS. 3 through 5, additional elements of control box 36 will now be described. A thermally insulated baffle 68, which in the preferred embodiment is made from a metal plate 70 to which fiber insulation 72 is attached, is shown disposed within the hollow interior of control box 36 with a length and width that is essentially coextensive with the length and width of the box. The baffle is spaced rearwardly away from front 58. When thus installed, thermally insulated baffle 68 forms a heat shield that thermally insulates the air space formed between baffle 68 and front 58. The air space between thermally insulated baffle 68 and front 58 forms a chimney, labeled generally at 80, through which air can flow by convective currents shown generally as arrow 82.

A bank of plugs 74, shown mounted in a terminal strip 76 labeled with unique identifiers 78, is shown attached to thermally insulated baffle 68. The bank of plugs need not be attached to the baffle, nor mounted in a terminal strip, however this makes for easier interconnection and disconnection of the controls to the heater. In the preferred embodiment, terminal strip 76 is a through-panel type terminal strip, thus providing an electrical connection through baffle 68.

A heater controller, shown generally as control components 84, is disposed within chimney 80. In the preferred embodiment, heater controller 84 is in the form of electronic controls 86 plus relays and transformers shown generally at 88. Electric controller outputs from heater controller 84 are shown in the form of output wires 92. Electric controller inputs to heater controller 84 are shown in the form of input wires 96. Referring now to FIG. 1, heater controller 84 includes a control panel 98.

Sockets 22 and plugs 74 form electrically mated pairs of connectors, whereby mating a socket with a plug interconnects a heater to an electric output. Any of the electrically mated pairs could be reversed if desired, such that the plug is attached to wire 20 and/or 21 and the socket is attached to the electric output wire 92 and/or input wire 96, without changing the functionality of the invention. As discussed above, the size and arrangement of the mated pairs can be varied as required by the electrical or other physical attributes of the inputs and outputs.

If access is needed to any of the components contained in the control box, closure device 60 is operated to allow the control box to rotate about hinge 28. When control box 36 is thus rotated about hinge 28, cable bumper 27 prevents power cable 59 from coming in direct contact with exterior 16, thus preventing damage to power cable 59 if exterior 16 is hot at the time. With control box 36 in its open position, wires 20 and 21, sockets 22 and plugs 74 are readily accessible, and can be operated on without the need for auxiliary support of control box 36. If it is necessary to conduct more extensive diagnostics, sockets 22 can be easily unplugged from plugs 74, and control box 36 can then be removed from the kiln by simply lifting the control box, thus unmating pins 38, 42 and 46 from receptacles 30, 32 and 34. After completing diagnostics, control box 36 can be easily reattached to the kiln by remating, the pins and receptacles. Sockets 22 are then plugged back onto plugs 74, matching each socket identifier 24 to the corresponding plug identifier 78 to insure that the correct socket is mated with the correct plug.

Louvers are provided in the top and bottom of control box 36, shown in the form of top louvers 100 having top openings 102, and bottom louvers 106 having bottom openings 108. Top louvers 100 are directed towards kiln exterior 16, and bottom louvers 106 are directed away from kiln exterior 16, as is best shown in FIG. 4. Air flows into bottom openings 108 as shown by air-flow-in arrow 110, and air flows out of top openings 102 as shown by air-flow-out arrow 104. While it would be possible to force the flow of air through chimney 80 by the use of a fan, in the preferred embodiment air flows by convective currents. By directing bottom louvers 106 away from exterior 16, air that is cooler than the air next to exterior 16 is drawn into chimney 80.

Referring to FIG. 1, kiln 10 further includes a lid 120 attached to kiln 10 by lid hinge 122. When lid 120 is in an open position, it can be held in that position by lid support 124. The kiln can be made up of separable sections, shown generally as 126, 128 and 130. Such kilns are referred to more generally as sectionalized kilns. Handles are attached to the exterior of each section, and are used to separate and carry the sections.

From the foregoing description it will be seen that the preferred embodiment that has been described is a kiln wherein the control box is easily attached and removed from the kiln. The control box has a hinge that supports the control box on one side, so that the control box can be pivoted relative to the kiln to allow access to the connections for the controls. The control box can be fixed in one place by the closure device, and most of the conductors attached to the control box are flexible to allow easy rotation of the control box about the hinge. The control box of the present invention is particularly applicable to sectionalized kilns, because the kilns are designed to be separated for maintenance procedures. Thus the fact that the control box is easily attached and removed from the kiln, and that the user of the kiln has easy access to the connections for the controls, greatly facilitates such maintenance procedures.

Once the control box has been opened, the required interconnections between the controls and the heater are easily accessible, and are in the form of plugs and sockets for easy connection and disconnection. When the plugs are disconnected from the sockets, the control box is easily lifted from the kiln, thus disengaging the pins from the receptacles and allowing the control box to be completely removed from the kiln.

Thermal protection for the controls is improved by providing a baffle that essentially covers all of the controls. Furthermore, the baffle is spaced away from the front of the control box, thus providing a chimney for improved air flow to cool the controls. The louvers on the top and bottom of the control box are placed to further improve the air flow through the chimney. By attaching a mounting plate to the exterior of the kiln, and disposing the mounting plate between the baffle and the exterior, a second chimney 133, as shown in FIGS. 4 and 5, is formed between the mounting plate and the baffle, and a third chimney 134, as shown in FIGS. 6 and is formed between the mounting plate and the exterior of the kiln, thus providing additional convective currents for cooling the controls.

While preferred embodiments and best modes of the invention have been disclosed, variations may be made thereto without departing from the spirit of the invention.

It is claimed and desired to secure by Letters Patent:

1. A kiln assembly comprising:

an upright body defining an enclosed space and having an exterior;

a heater associated with the body to heat the enclosed space;

a control box disposed on the body, where the control box includes an interior; and a hinge mounting the control box to the exterior, and permitting the control box to be pivoted around a vertical axis along the direction of the upright body to permit access to the interior of the control box.

2. The kiln assembly of claim 1 wherein the hinge comprises:

an upper pin part and an upper receptacle part, with one part connected to the exterior and the other part to the control box; and a lower pin part and a lower receptacle part, with one part connected to the exterior and the other part to the control box;

where the upper pin part and the upper receptacle part are spaced from the lower pin part and the lower receptacle part; and where the vertical axis is defined by the upper pin part and upper receptacle part and the lower pin part and the lower receptacle part so that the control box pivots around both the upper pin part and upper receptacle part and the lower pin part and the lower receptacle part.

3. The kiln assembly of claim 2, wherein the length of each pin part and the location of each receptacle part is such that the control box is attached to the exterior by first mating one of the pin parts with the corresponding receptacle part and then mating the other pin part with the other receptacle part.

4. The kiln assembly of claim 2, further comprising a middle pin part and a middle receptacle part with one part connected to the exterior and the other part to the control box, where the middle pin part and the middle receptacle part are positioned between the upper and lower pin parts.

5. The kiln assembly of claim 4, wherein the length of each pin part and the location of each receptacle part is such that the control box is attached to the exterior by first mating one of the pin parts with the corresponding receptacle part, then mating another of the pin parts with the corresponding receptacle part, and then mating the remaining pin part with the remaining receptacle part.

6. The kiln assembly of claim 2, wherein the receptacle parts and the pin parts are sized so that the control box is spaced away from the exterior, and the control box is only in direct thermal contact with the exterior at the pin parts and receptacle parts.

7. The kiln assembly of claim 2, wherein the control box further comprises a closure device configured to selectively fix the control box to the exterior and to prevent the control box from pivoting.

8. The kiln assembly of claim 7, wherein:

the receptacle parts and the pin parts are sized so that the control box is spaced away from the exterior;

the closure device includes a spacer disposed between the control box and the exterior; and the control box is only in direct thermal contact with the exterior at the pin parts, receptacle parts and closure device.

9. The kiln assembly of claim 8, wherein the closure device includes a screw that extends through the spacer and penetrates the exterior.

10. The kiln assembly of claim 2, wherein the control box has a front that faces outwardly, and further comprising:

a thermally insulated baffle disposed within the interior of the control box and spaced rearwardly away from the front of the control box, the baffle being substantially coextensive with the length and width of the control box to form a chimney between the baffle and the front; and a heater controller disposed within the chimney, wherein the baffle forms a heat shield for protecting the heater controller from heat when the kiln is operational.

11. The kiln assembly of claim 10, further comprising:

a plurality of electric outputs from the heater controller; and a bank of plugs exposed on the baffle facing the kiln, and interconnecting the electric outputs to the heater via electrically conductive wires.

12. The kiln assembly of claim 11, wherein the plugs are fixed in a strip.

13. The kiln assembly of claim 12, wherein the strip is attached to the baffle.

14. The kiln assembly of claim 11, wherein each plug is labelled with a unique identifier, and each corresponding socket is labelled with a corresponding identifier to allow easy identification for mating each plug with each corresponding socket.

15. The kiln assembly of claim 10, further comprising louvers on the control box to allow the flow of air through the chimney to cool the heater controller.

16. The kiln assembly of claim 15, wherein:

the control box further includes a bottom and a top;

the louvers are located on the bottom and the top;

the louvers on the bottom are directed away from the exterior to better draw cool air into the chimney; and the louvers on the top are directed towards the exterior.

17. The kiln assembly of claim 1, which further comprises:

an insulated baffle extending the length and width of the control box within the control box and spaced towards to the back of the control box from the front of the control box; and control components disposed within the control box and being located intermediate the baffle and the front of the control box.

18. The kiln assembly of claim 17, which further includes electric power supply conductors for supplying current for heating the kiln and a bank of plugs disposed on the baffle facing the kiln connecting the conductors and control components.

19. The kiln assembly of claim 1 wherein the body is separable into at least two sections.

20. A kiln assembly comprising:

a body defining an enclosed space and having an exterior and interior and a top opening;

heater coils adjacent the body's interior to heat the enclosed space;

a lid adjacent the body for closing the top opening;

a control box;

a hinge connecting the control box to the body's exterior and allowing the control box to pivot;

a heater controller disposed within the control box to control the heat produced by the heater coils, wherein the heater controller has a plurality of electric outputs; and a connection between the electric outputs and the heater coils.

21. A kiln assembly comprising:

a body defining an enclosed space and having an exterior;

a heater associated with the body to heat the enclosed space;

a hollow control box attached to the exterior, wherein the control box has a bottom and a top;

louvers on the control box to allow the flow of air through the control box;

wherein the louvers are located on the bottom and the top;

wherein the louvers on the bottom are directed away from the exterior; and wherein the louvers on the top are directed towards the exterior.

22. A kiln assembly comprising:

a body defining an enclosed space and having an exterior;

a heater associated with the body to heat the enclosed space;

a hollow control box attached to the exterior, wherein the control box has a front that faces outward and an open back that faces the exterior;

a thermally insulated baffle disposed within the control box spaced rearwardly from the front, and having a length and width substantially coextensive with the length and width of the control box to form a chimney between the baffle and the front; and a heater controller disposed within the chimney, so that the baffle forms a heat shield protecting the heater controller from heat when the kiln is operational.

23. The kiln assembly of claim 22, further comprising louvers on the control box to allow the flow of air through the chimney to cool the heater controller.

24. The kiln assembly of claim 23, wherein:

the control box includes a bottom and a top;

the louvers are located on the bottom and the top;

the louvers on the bottom are directed away from the exterior to better draw cool air into the chimney; and the louvers on the top are directed towards the exterior.

25. The kiln assembly of claim 23, further comprising a mounting plate attached to the exterior and disposed between the thermally insulated baffle and the exterior to form a second chimney between the baffle and the mounting plate, and a third chimney between the mounting plate and the exterior.

26. A kiln assembly comprising:

a body defining an enclosed space and having an exterior and interior and a top opening;

heater coils adjacent the body's interior and substantially surrounding the enclosed space to heat the enclosed space;

a lid adjacent the body for closing the top opening:

a control box attached to the exterior;

a heater controller disposed within the control box, wherein the heater controller has a plurality of electric outputs; and a bank of plugs interconnecting the electric outputs to the heater coils via electrically conductive wires.

27. The kiln assembly of claim 26, wherein the plugs are fixed in a strip.

28. The kiln assembly of claim 27, wherein the strip is attached to the control box.

29. The kiln assembly of claim 28, further comprising sockets on the electrically conductive wires to connect with the bank of plugs, wherein each plug is labeled with a unique identifier, and each corresponding socket is labeled with a corresponding identifier to allow easy identification for mating each plug with each corresponding socket.

30. A kiln assembly comprising:

a body defining an enclosed space and having an exterior;

a heater associated with the body to heat the enclosed space;

a control box disposed on the body, where the control box includes an interior;

a first hinge mounting the control box to the exterior; and a second hinge mounting the control box to the exterior;

where the first and second hinges are spaced apart and define an axis around which the control box is pivoted to permit access to the interior of the control box.

31. The kiln assembly of claim 1 wherein the hinge comprises a cylindrical member and a receptacle having a circular aperture into which the cylindrical member may be inserted for rotation.

* * * * *